US007958826B2

(12) United States Patent
Thomas, III et al.

(10) Patent No.: US 7,958,826 B2
(45) **Date of Patent: *Jun. 14, 2011**

(54) VARIABLE DISTANCE DETONATION MECHANISM

(76) Inventors: Robert S. Thomas, III, Westminister, MD (US); Edward C. Waters, III, New Windsor, MD (US)

( * ) Notice: Subject to any disclaimer, the term of this patent is extended or adjusted under 35 U.S.C. 154(b) by 225 days.

This patent is subject to a terminal disclaimer.

(21) Appl. No.: 12/209,519

(22) Filed: Sep. 12, 2008

(65) Prior Publication Data

US 2010/0288154 A1 Nov. 18, 2010

Related U.S. Application Data

(63) Continuation-in-part of application No. 12/155,168, filed on May 30, 2008, now Pat. No. 7,861,656.

(60) Provisional application No. 60/924,774, filed on May 31, 2007.

(51) Int. Cl.
*F42B 27/00* (2006.01)
*F42C 9/04* (2006.01)

(52) U.S. Cl. ..... 102/487; 102/276

(58) Field of Classification Search ..... 102/240, 102/260, 261, 275.11, 276, 396, 397, 486, 102/487, 488, 499

See application file for complete search history.

(56) References Cited

U.S. PATENT DOCUMENTS

| | | | | | |
|---|---|---|---|---|---|
| 1,181,190 | A | * | 5/1916 | Welton | 102/486 |
| 1,340,546 | A | * | 5/1920 | Keeran | 102/397 |
| 2,396,064 | A | * | 3/1946 | Van Karner | 102/487 |
| 2,469,587 | A | * | 5/1949 | Wittel | 102/260 |
| 2,644,399 | A | * | 7/1953 | Knowlton | 102/260 |
| 3,296,968 | A | * | 1/1967 | Shulman et al. | 102/204 |
| 3,331,321 | A | * | 7/1967 | Kirby, II | 102/232 |
| 3,340,810 | A | * | 9/1967 | Di Paola | 102/487 |
| H000136 | H | * | 10/1986 | Field | 102/487 |
| H000251 | H | * | 4/1987 | Field | 102/487 |
| 4,662,278 | A | * | 5/1987 | Lillios | 102/223 |
| 6,460,460 | B1 | | 10/2002 | Jasper, Jr. et al. | |
| 6,761,117 | B1 | | 7/2004 | Benz | |
| 2006/0278115 | A1 | * | 12/2006 | Juy | 102/487 |
| 2010/0043663 | A1 | | 2/2010 | Grosch et al. | |

* cited by examiner

*Primary Examiner* — Bret Hayes
(74) *Attorney, Agent, or Firm* — Welsh Flaxman & Gitler LLC

(57) ABSTRACT

A grenade includes an explosion chamber having an explosive charge to which an ignition charge is connected. The grenade also includes a primer and trigger coupled to the ignition charge for detonation of the explosive charge held within the explosion chamber. A variable distance detonation mechanism has a trigger and primer for allowing controlled detonation of the grenade a specific distance from the launch point thereof.

5 Claims, 15 Drawing Sheets

FRONT VIEW

FRONT VIEW

RIGHT VIEW

TOP VIEW

VARIABLE DISTANCE DETONATION MECHANISM

CROSS REFERENCE TO RELATED APPLICATIONS

This application is a continuation-in-part of U.S. patent application Ser. No. 12/155,168, filed May 30, 2008 now U.S. Pat. No. 7,861,656, entitled "Variable Distance Detonation Mechanism", which is currently pending, which claims the benefit of U.S. Provisional Patent Application Ser. No. 60/924,774, entitled "Variable Distance Detonation Mechanism", filed May 31, 2007.

BACKGROUND OF THE INVENTION

1. Field of the Invention

The invention relates to a grenade. More particularly, the invention relates to a grenade with a variable distance detonation mechanism.

2. Description of the Related Art

Grenades have been available for a very long time. In particular, grenades function by releasing a safety mechanism, for example, with the withdrawal of a pin. Once the safety mechanism is released, the user has a limited amount of time before the grenade detonates. As such, the user typically throws the grenade and the grenade detonates a specific time after the pin has been pulled. However, accuracy with regard to exact location of detonation has always been one of the shortcomings of the utilization of grenades. As such, a need exists for a detonation mechanism which allows a user to control the specific location at which the grenade detonates. The present invention provides such a mechanism.

SUMMARY OF THE INVENTION

It is, therefore, an object of the present invention to provide a grenade including an explosion chamber having an explosive charge to which an ignition charge is connected. A primer and trigger are coupled to the ignition charge for detonation of the explosive charge held within the explosion chamber. A variable distance detonation mechanism is coupled to the trigger and the primer for allowing controlled detonation of the grenade a specific distance from a launch point thereof. The variable distance detonation mechanism includes a rotating activation mechanism that acts upon the trigger for detonation of the grenade.

It is also an object of the present invention to provide a grenade wherein the rotating activation mechanism includes a trigger nut mounted upon an adjustment bolt such that the trigger nut selectively rotates relative to the adjustment bolt in a manner creating longitudinal movement of the trigger nut along the adjustment bolt for actuation of the trigger.

It is another object of the present invention to provide a grenade wherein a spool is rotatably connected to the trigger nut and the adjustment bolt via a gearing arrangement that creates rotation of the adjustment bolt as a string is pulled from the spool.

It is a further object of the present invention to provide a grenade wherein a trigger arm is coupled to the trigger and the trigger nut acts upon the trigger arm for actuation of the trigger.

It is also another object of the present invention to provide a grenade wherein the trigger arm includes multiple contact surfaces for selective engagement with the trigger nut as it is moved along the adjustment bolt.

It is a further object of the present invention to provide a grenade including a trigger stop mechanism preventing movement of the trigger.

It is also an object of the present invention to provide a grenade wherein the trigger stop mechanism includes a bolt secured to the trigger such that the trigger may only be moved when a stop plate member is moved out the way of the bolt permitting movement of the trigger.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
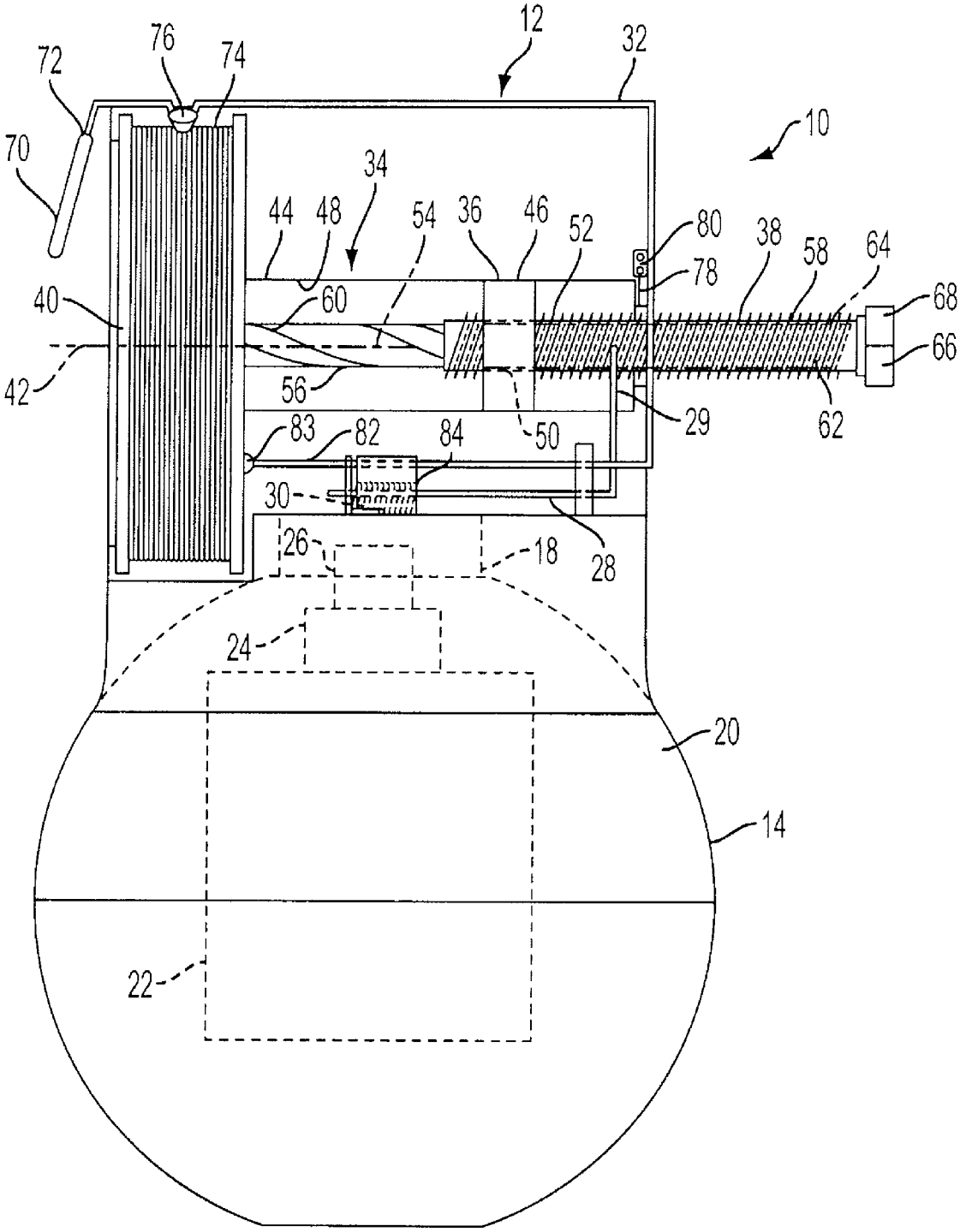
FIG. 1 is a schematic of the present detonation mechanism secured to a grenade body.
Figure 2A:
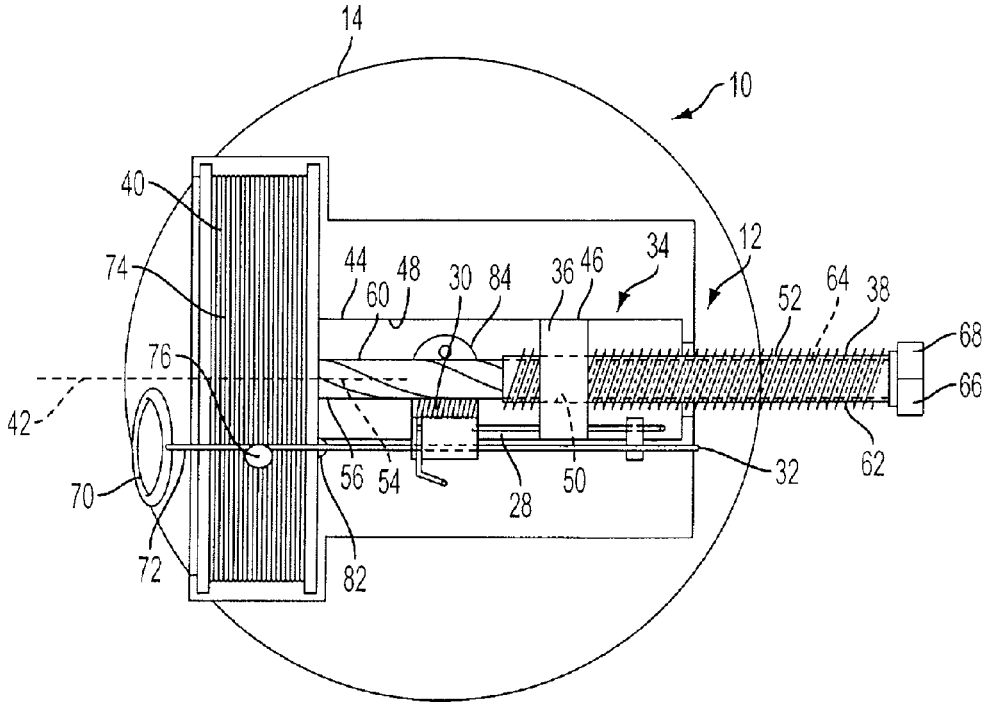
FIG. 2A is a top view of the present detonation mechanism.
Figure 2B:
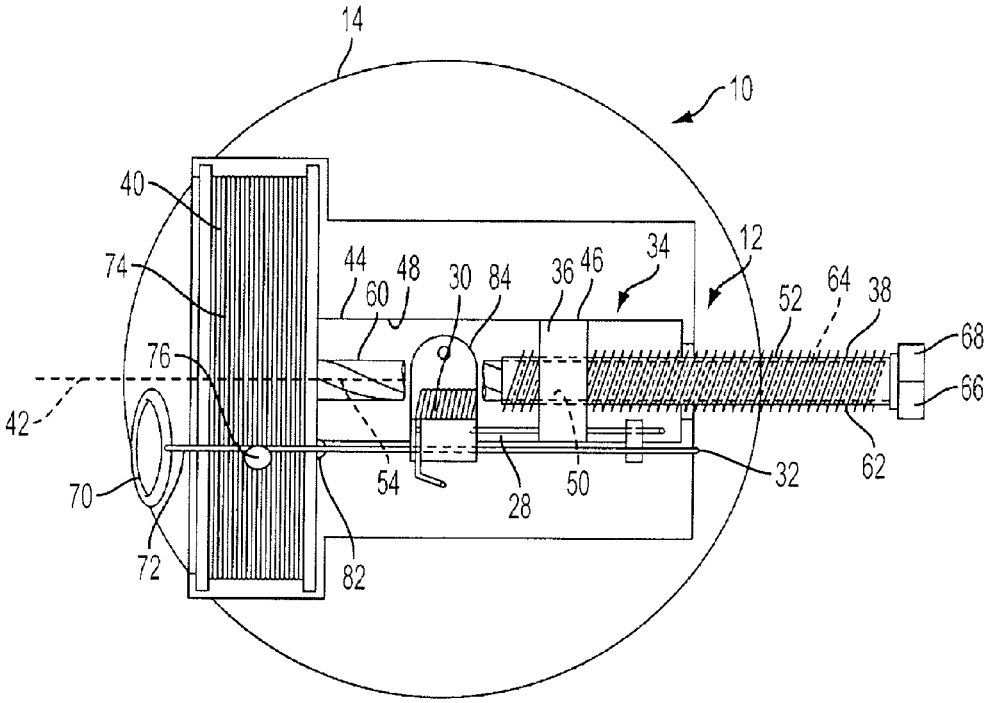
FIG. 2B is a top view of the present detonation mechanism with a portion cut-away to show the spring plate.
Figure 3:
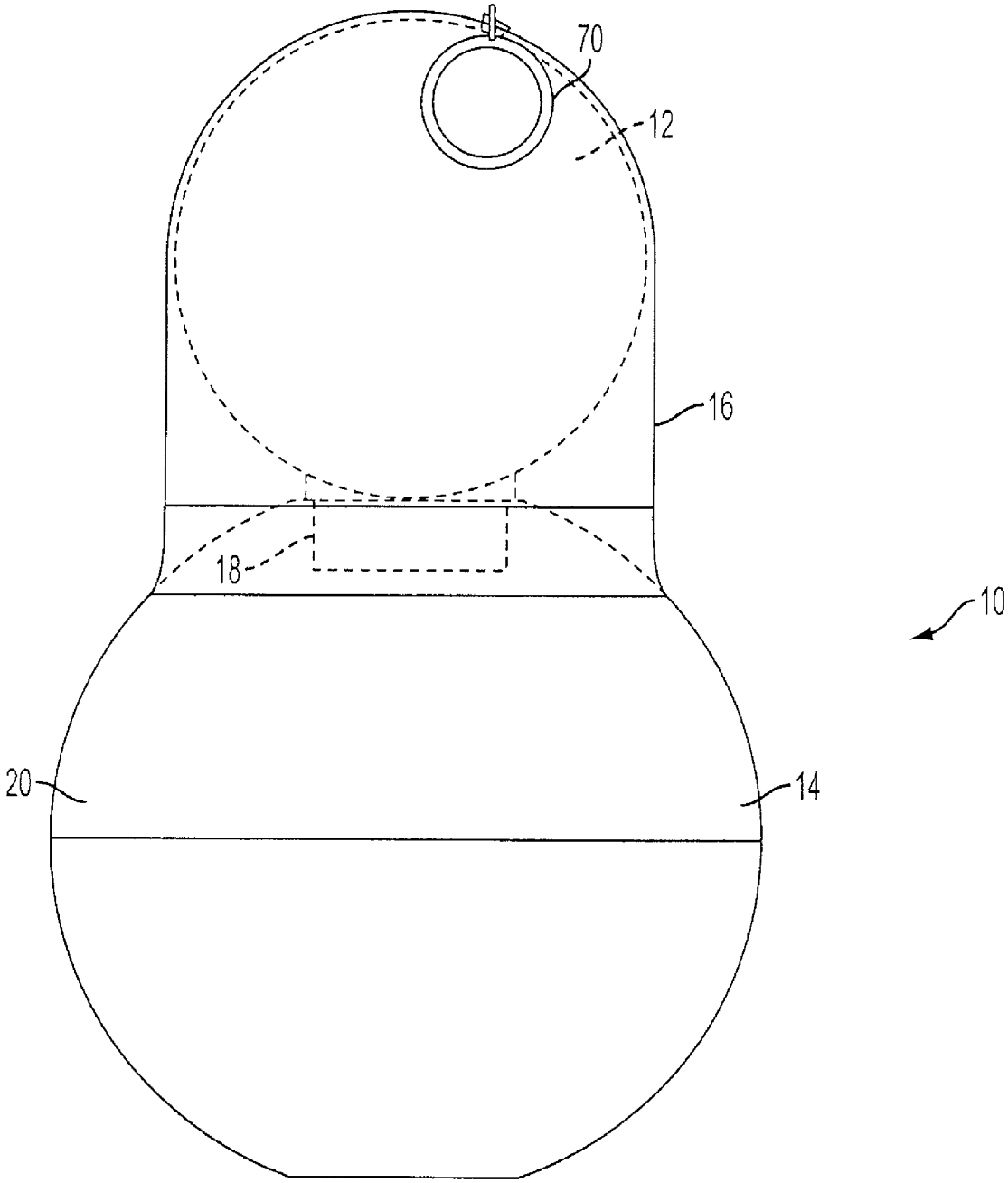
FIGS. 3 and 4 are respectively a side view and front view of a grenade employing the present detonation mechanism.
Figure 4:
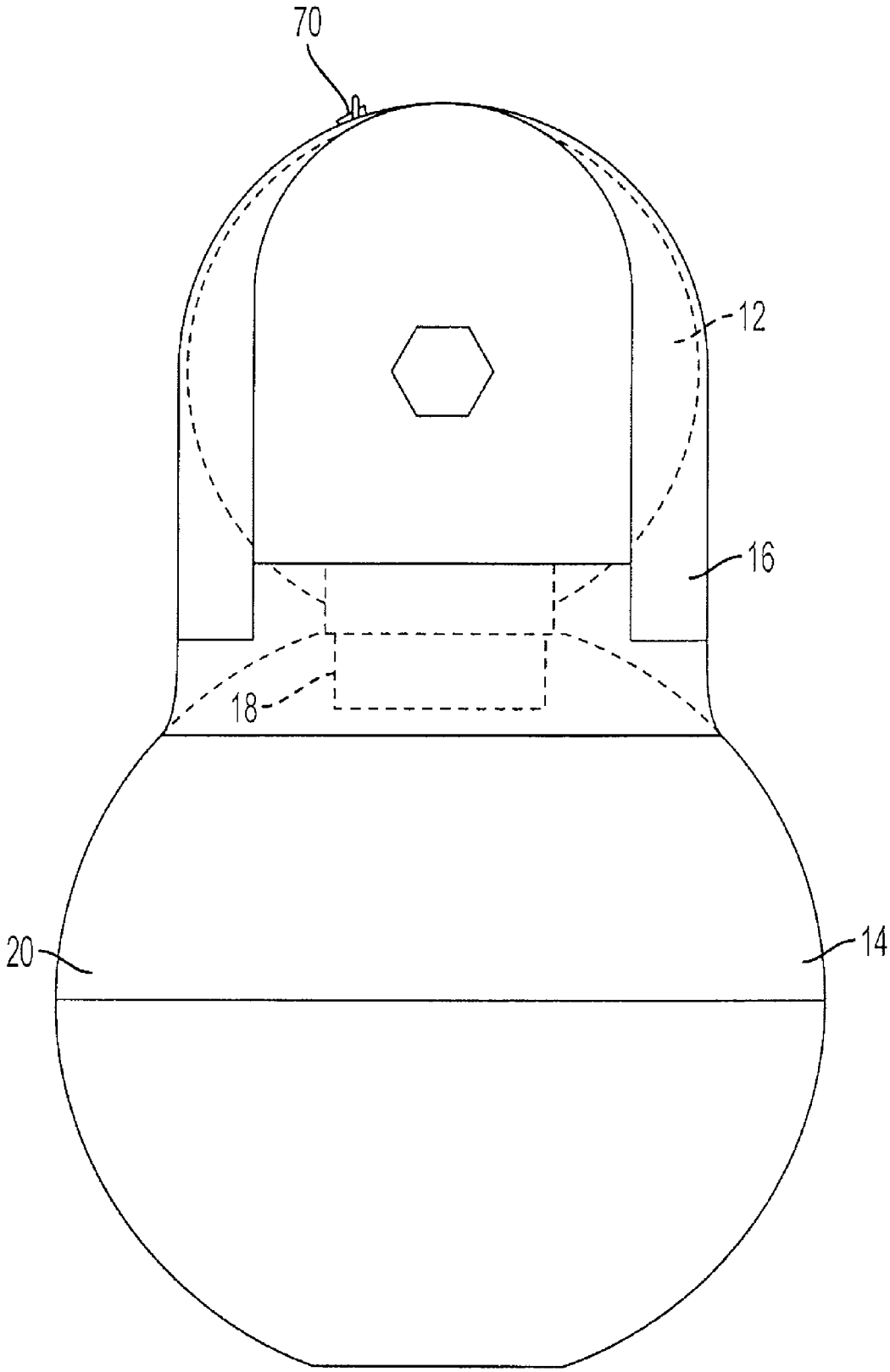
Figure 5:
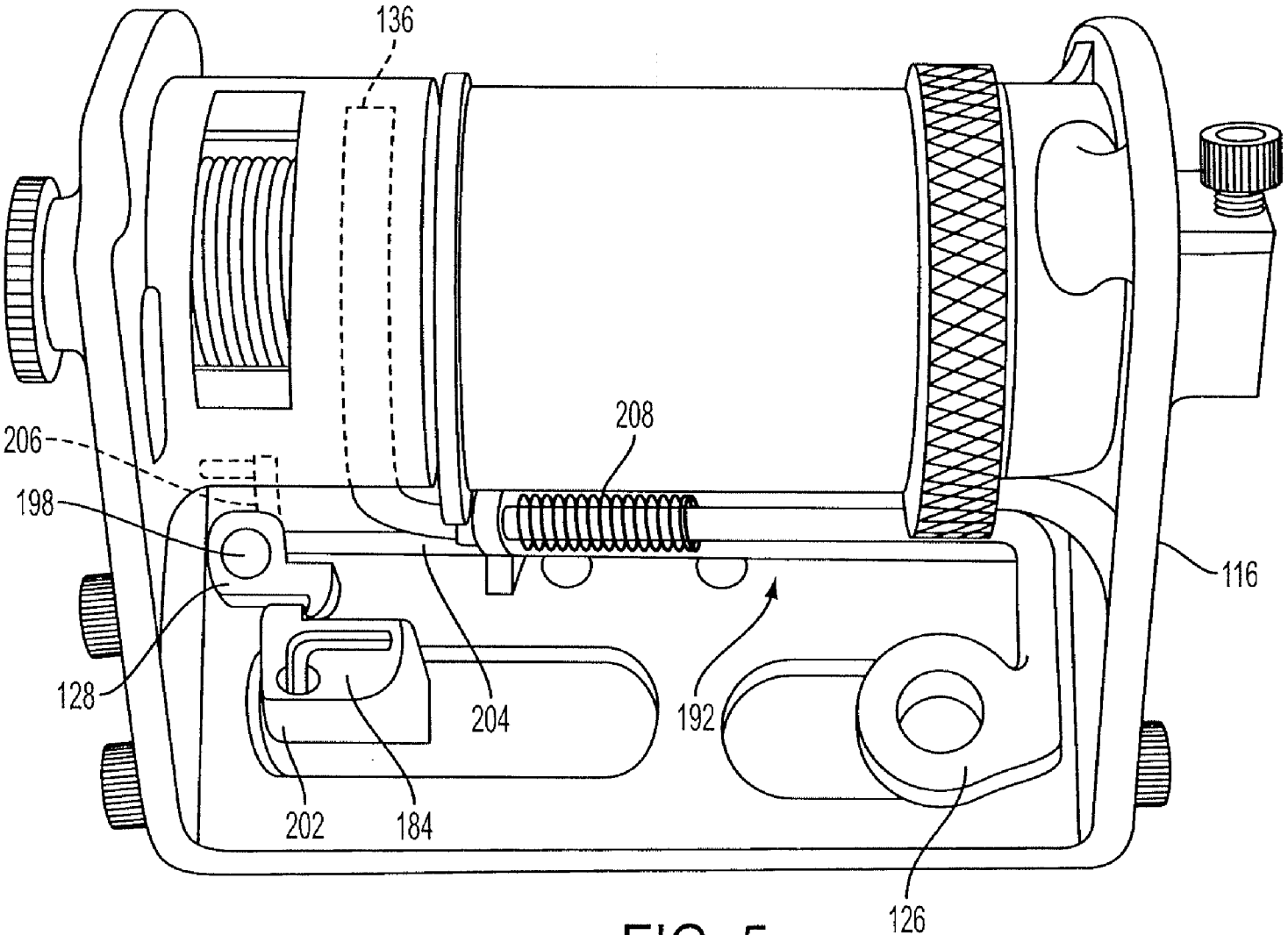
FIGS. 5, 6 and 7 are various views of an alternate embodiment employing additional safety mechanisms in its predetonated configuration.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With regard to the various figures, a grenade 10 including a variable distance detonation mechanism 12 is disclosed. Although the present grenade 10 is disclosed with regard to a fragmentary grenade, the present variable distance detonation mechanism 12 may be applied to smoke grenades or any other explosive device that utilizes a primer igniter. In addition, the variable distance detonation mechanism of the present invention can be oriented vertically or horizontally to aide ergonomics or to fashion a handle. In particular, the present variable distance detonation mechanism 12 is screwed onto traditional grenade bodies 14 in a manner allowing existing grenade bodies 14 to be replaced as needed with the present variable distance detonation mechanism 12. As such, the housing 16 of the present variable distance detonation mechanism 12 is provided with a threaded attachment 18 for screwing the variable distance detonation mechanism 12 to the grenade body 14 in a manner well know to those skilled in the art.

In particular, and with the exception of the variable distance detonation mechanism 12, the present grenade 10 operates in much the same manner as conventional grenades. As such, it includes an explosion chamber 20 including an explosive charge 22 to which an ignition charge 24 is connected. The ignition charge 24 is detonated by the primer 26 and trigger 28 of the present variable distance detonation mechanism 12. As will be discussed below in greater detail, when the trigger 28 is moved to permit firing of the primer 26 via the bias supplied by the primer detonation spring 30, the ignition charge 24 is ignited detonating the explosive charge 22 held within the explosion chamber 20.

Controlled activation of the trigger 28, primer detonation spring 30 and primer 26 is achieved by the present variable distance detonation mechanism 12. The variable distance detonation mechanism 12 includes a pull pin safety tether 32 linked to a rotating activation mechanism 34 that ultimately acts upon the trigger 28 to release the primer detonation spring 30 that acts upon the primer 26 to ignite the ignition charge 24 and explosive charge 22.

The activation mechanism 34 includes a trigger nut 36 mounted upon a distance adjustment bolt 38. The trigger nut 36 is capable of rotating along the distance adjustment bolt 38 so as to set the distance between the trigger nut 36 and the trigger 28 to thereby adjust the distance at which the trigger 28 will be actuated to detonate the present grenade 10. A spool 40 is fixedly connected to the trigger nut 36 permitting rotation of the trigger nut 36 as the pull pin safety tether 32 is pulled from the spool 40.

More particularly, the activation mechanism 34 relies upon movement of the trigger nut 36 as it is guided along adjustment bolt 38. The activation mechanism 34 includes a spool 40 that is mounted within the housing 16 of variably distance detonation mechanism 12 for rotational movement about a first axis 42. The spool 40 is rigidly connected to a cylindrical support arm 44 in which the trigger nut 36 is mounted for rotational movement relative to the adjustment bolt 38. The trigger nut 36 is mounted within the cylindrical support arm 44 in a keyed relationship. The keyed relationship allows the trigger nut 36 to rotate with the cylindrical support arm 44 in a manner discussed below in greater detail, while permitting the trigger nut 36 to move along the length of the cylindrical support arm 44. In accordance with a preferred embodiment, the trigger nut 36 includes a common hexagonal external surface 48 and the cylindrical support arm includes a hexagonal internal surface shaped and dimensioned for mating receipt of trigger nut 36.

The trigger nut 36 includes internal threading 50 shaped and dimensioned to mate with external threading 52 on the adjustment bolt 38. As a result, when string 74 is drawn from the spool 40 causing it to rotate, and ultimately the cylindrical support arm 44 are rotated upon activation of the present variable distance detonation mechanism 12, the trigger nut 36 is rotated along the adjustment bolt 38 causing the trigger nut 36 to move along the adjustment bolt 38 until such a time as the trigger nut 36 hits the trigger arm 29 of the trigger 28 in a manner discussed below in greater detail. With this in mind, the cylindrical support arm 44 includes a longitudinal axis 54 that is substantially aligned with the first axis 42 about which the spool 40 rotates.

A distance selector stabilizer pin 56 is fixedly coupled to the housing 16 of the variable distance detonation mechanism 12 and connects the adjustment bolt 38 perpendicular to the spool 40 such that the adjustment bolt 38 also rotates about an axis substantially in line with the first axis 42 about which the spool 40 rotates. The distance selector stabilizer pin 56, the adjustment bolt 38 and the trigger nut 36 are positioned within, and aligned with, the cylindrical support arm 44.

The adjustment bolt 38 is mounted upon the distance selector stabilizer pin 56 in a telescoping relationship. The adjustment bolt 38 includes a central recess 58 in which the distance selector stabilizer pin 56 is positioned. The distance selector stabilizer pin 56 includes external threads 60 that are shaped and dimensioned to mate with internal threads 62 formed along the internal surface 64 of the adjustment bolt 38 and within the central recess 58. In this way, rotation of the adjustment bolt 38 relative to the distance selector stabilizer pin 56 will cause the adjustment bolt 38 to telescopically adjust its position along the length of the distance selector stabilizer pin 56. It should be appreciated the torque required to rotate the adjustment bolt 38 relative to the distance selector stabilizer pin 56 should be greater than the torque required for the trigger nut 36 to rotate upon the adjustment bolt 38 so that the adjustment bolt 38 does not further rotate relative the distance selector stabilizer pin 56 one the relative positioning of the adjustment bolt 38 therein is set.

The respective threading 60, 62 of the distance selector stabilizer pin 56 and the adjustment bolt 38 allows for substantial linear movement of the adjustment bolt 38 along the distance selector stabilizer pin 56 with minimal rotation of the adjustment bolt 38. This in turn allows for adjustment of the trigger nut 36 relative to the trigger 28 in a manner that will be discussed below in greater detail. Rotation of the adjustment bolt 38 relative to the distance selector stabilizer pin 56 for the purpose of adjusting the position of the adjustment bolt 38, and ultimately the trigger nut 36 within the cylindrical support arm 44, is facilitated by providing the adjustment bolt 38 with a handle member 66 at the free end 68 thereof. In accordance with a preferred embodiment of the present invention, the handle member 66 is a knob shaped and dimensioned for gripping and rotation of the adjustment bolt 38, although those skilled in the art will appreciate a variety of handle members may be employed without departing from the spirit of the present invention.

In accordance with a preferred embodiment of the present invention, counterclockwise rotation of the adjustment bolt 38 causes the adjustment bolt to move over the distance selector stabilizer pin 56 and toward the spool 40. This moves the trigger nut 36, which is support upon the adjustment bolt 38, away from the trigger arm 29 of the trigger 28. As a result, the distance the grenade 10 must be thrown, or otherwise displaced, from a user holding a ring 70 attached to the string 74 of the spool 40 increases because the trigger nut 36 must be rotated more to move it further along the threading linking the trigger nut 36 to the adjustment bolt 38. Conversely, the trigger nut 36 is moved closer to the trigger arm 29 of the trigger 28 by rotating the adjustment bolt 38 clockwise along the distance selector stabilizer pin 56. This in turn decreases the distance the grenade 10 must be thrown, or otherwise displaced, from a user holding a ring 70 attached to the string 74 of the spool 40 increases because the trigger nut 36 must be rotated less to move it the shorter distance along the threading linking the trigger nut 36 to the adjustment bolt 38.

In practice, a ring 70 at the first end 72 of the pull pin safety tether 32 is gripped and pulled away from the housing 16. This causes the pull pin safety tether 32 to be pulled from the housing 16 in a manner initiating the detonation process. The detonation of the present variable distance detonation mechanism 12 is achieved in a multiple step process ensuring safe and efficient operation of the present variable distance detonation mechanism 12, and ultimately the grenade 10 to which it is attached. As the pull pin safety tether 32 is drawn about the housing 16 and away from the spool 40, unwinding of the spool 40 is started because the string 74 wrapped around the spool 40 is fixedly coupled to the pull pin safety tether 32. In particular, the free end 76 of the string 74 of the spool 40 is secured adjacent the first end 72 of the pull pin safety tether 32 at a positioned adjacent the ring 70.

In addition to beginning the unwinding of the string 74 from the spool 40, the initial pull of the pull pin safety tether 32 releases a safety pin 78 allowing spring 80 to force the safety pin 78 into contact with the adjustment bolt 38. Contact of the safety pin 78 with the adjustment bolt 38 will fracture the adjustment bolt 38 causing the free end 68 of the adjustment bolt 38 to break away from the remainder of the adjustment bolt 38 and fall from the present variable distance detonation mechanism 12. In accordance with a preferred embodiment, the adjustment bolt 38 is manufactured from bakelite (a synthetic resin) or plastic, includes perforations along its length to facilitating breaking thereof when the safety pin 78 comes into contact. Removal of the exposed free end of the adjustment bolt 38 helps to ensure that the string 74 of the spool 40 will not become tangled thereon, creating problems during use of the present activation mechanism. In addition to fracturing the adjustment bolt 38, the safety pin 78 will also frictionally engage the remainder of the adjustment bolt 38, holding it in position as the trigger nut 36 is rotated relative thereto in accordance with the present invention.

Once the safety pin 78 has been released and the free end 68 of the adjustment bolt 38 has been removed, the pull pin safety tether 32 is further pulled to withdraw the second end 82 from a position adjacent the spool 40. The spool 40 is provided with control bump 83 shaped and dimensioned to engage the second end 82 of the pull pin safety tether 32 so as to prevent inadvertent unwinding until the pull pin safety tether 32 is withdrawn. As the second end 82 of the pull pin safety tether 32 is drawn from the housing 16, the second end 82 of the pull pin safety tether 32 is removed from its position blocking motion of the spring plate 84 secured to the primer detonation spring 30.

In particular, the second end 82 of the pull pin safety tether 32 is oriented in a position blocking rotation of the spring plate 84, which ultimately blocks the spring plate 84 from contact with the primer 26. This is a safety mechanism built into the present variable distance detonation mechanism 12 and prevents inadvertent detonation until such a time the user pulls the pull pin safety tether 32 from the housing 16.

Once the pull pin safety tether 32 is fully removed from the housing 16, the user may throw the grenade 10 with one hand while holding the ring 70 with the other hand. That is, the grenade 10 is armed and can be either thrown while retaining the pull pin safety tether 32 or placed at a desired location. In either case, as the pull pin safety tether 32 is pulled further from the spool 40, the string 74 connected between the spool 40 and the pull pin safety tether 32 is withdrawn from the spool 40 causing the spool 40 to rotate. Rotation of the spool 40 in turn causes the support arm 44 to rotation in a manner causing rotation of the trigger nut 36. As the trigger nut 36 rotates upon the adjustment bolt 38, the threading therebetween causes the trigger nut 36 to be brought closer and closer to the trigger 28. As the grenade 10 is thrown a distance from the user, the string 74, which is held at is first end 76 by the user gripping the ring 70, will unwind from the spool 40 causing the spool 40 to rotate. Rotation of the spool 40 will similarly cause rotation of the cylindrical support arm 44 to which the trigger nut 36 is coupled for rotation therewith.

More particularly, as the trigger nut 36 is rotated under the force created by rotation of the spool 40, it will move along the adjustment bolt 38 with the threading of the trigger nut 36 interacting with the threading of the adjustment bolt 38. The trigger nut 36 will eventually come into contact with the trigger arm 29 of the trigger 28.

The distance the trigger nut 36 must travel before coming into contact with the trigger 28 is directly related to the distance the grenade 10 must travel and the amount of string 74 that must be unwound from the spool 40. As those skilled in the art will certainly appreciate, this is based upon the diameter of the spool 40, the threading of the trigger nut 36/adjustment bolt 38, and the distance the trigger nut 36 is positioned from the trigger 28. As a result, one can readily adjust the distance the grenade 10 must travel before detonation by adjusting the distance the trigger nut 36 is positioned relative to trigger 28 by to throwing the present grenade 10. As mentioned above this is achieved by rotating the adjustment bolt 38 relative to the distance selector stabilizer pin 56, which ultimately moves the adjustment bolt 38 and the trigger nut 36 within the cylindrical support arm 44 for positioning of the trigger nut 36 relative to the trigger 28.

When the trigger nut 36 comes into contact with the trigger 28 and moves it, the trigger 28 is moved from its position blocking the primer detonation spring 30. The primer detonation spring 30 is then released, causing the spring plate 84 attached to the primer detonation spring 30 to contact the primer 26 igniting the ignition charge 24 which ultimately ignites the explosive charge 22 held within the explosion chamber 20.

Figure 6:
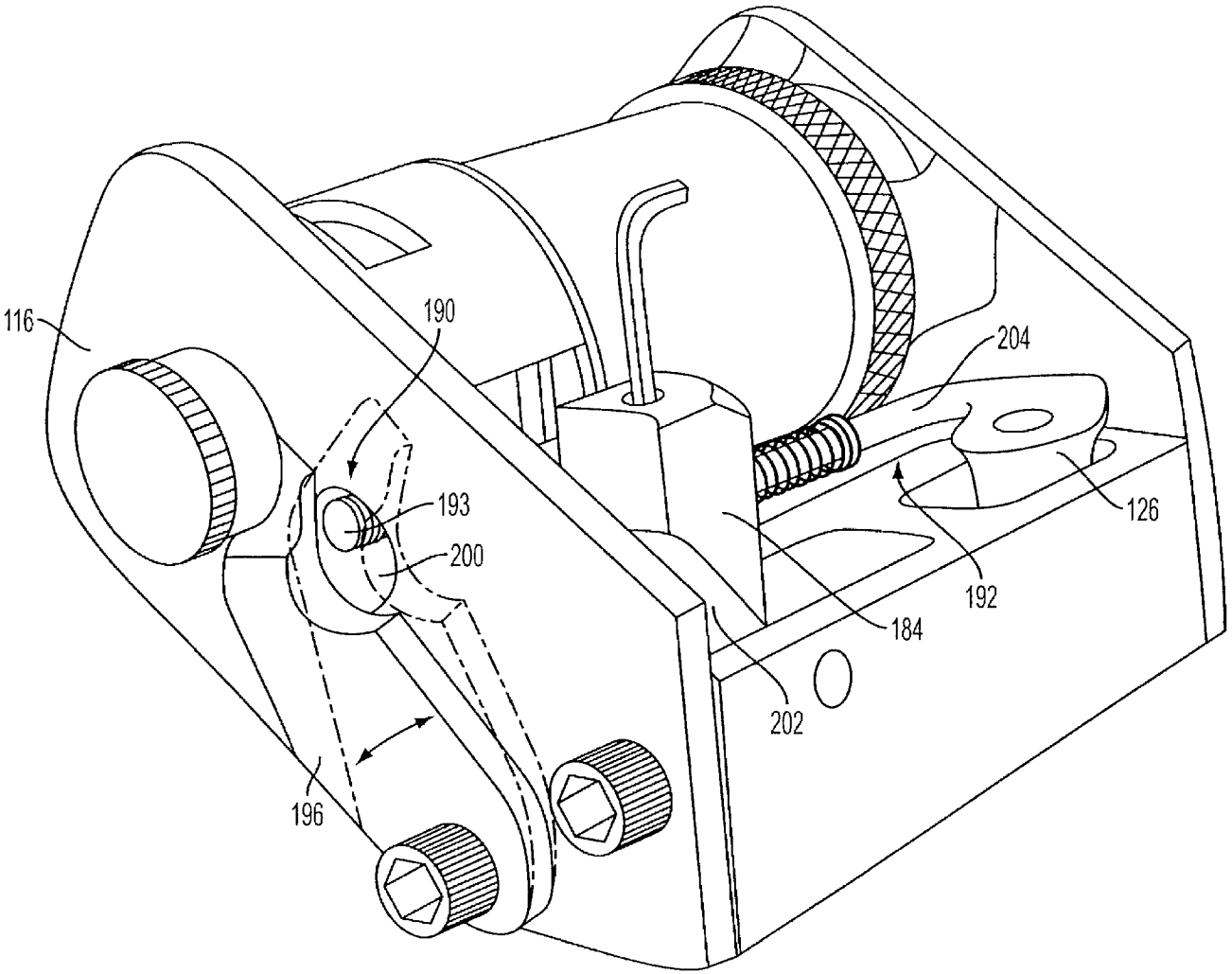
Figure 7:
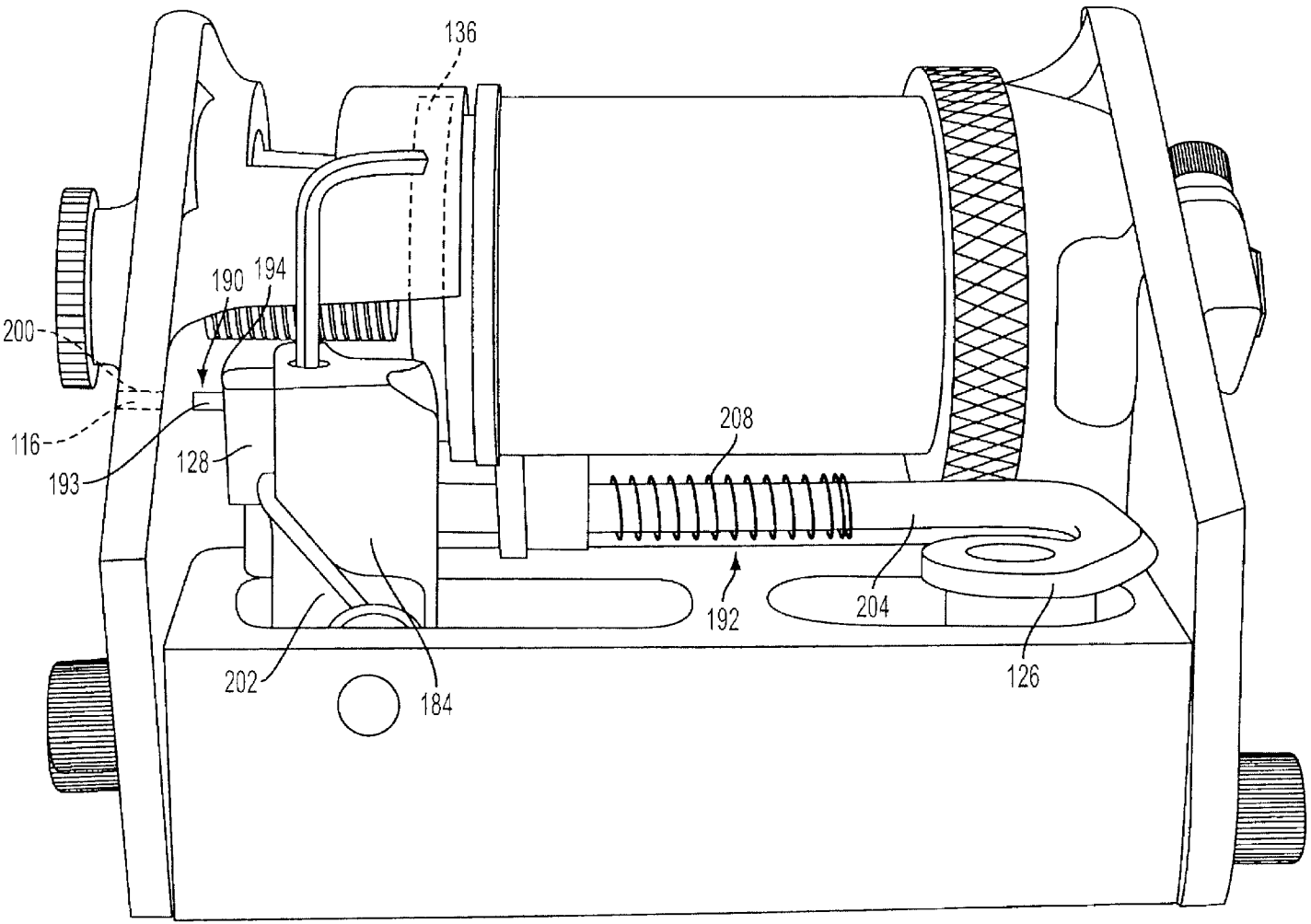
Figure 8:
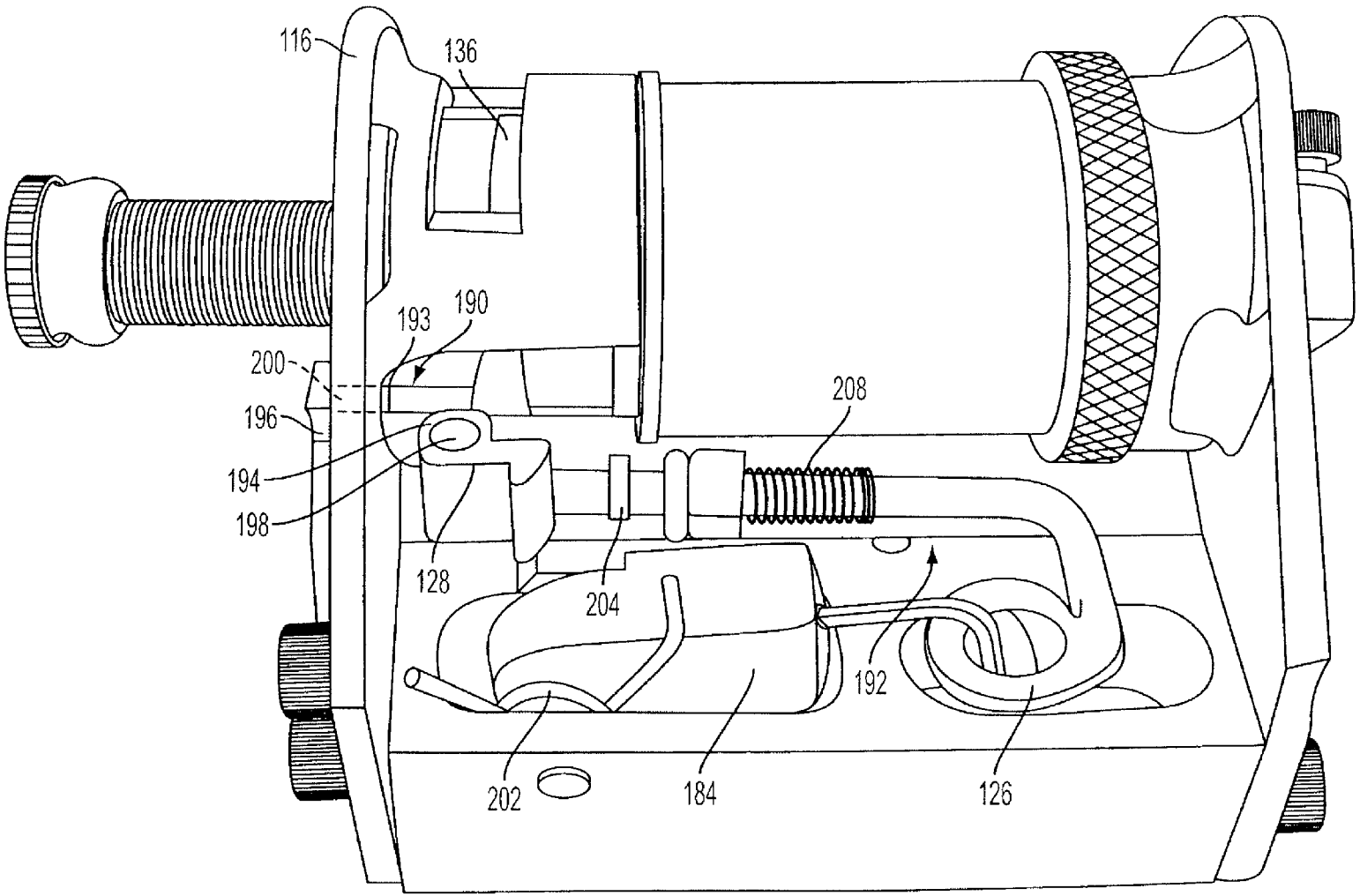
FIGS. 8 and 9 are various views of an alternate embodiment employing additional safety mechanisms in its detonated configuration.
Figure 9:
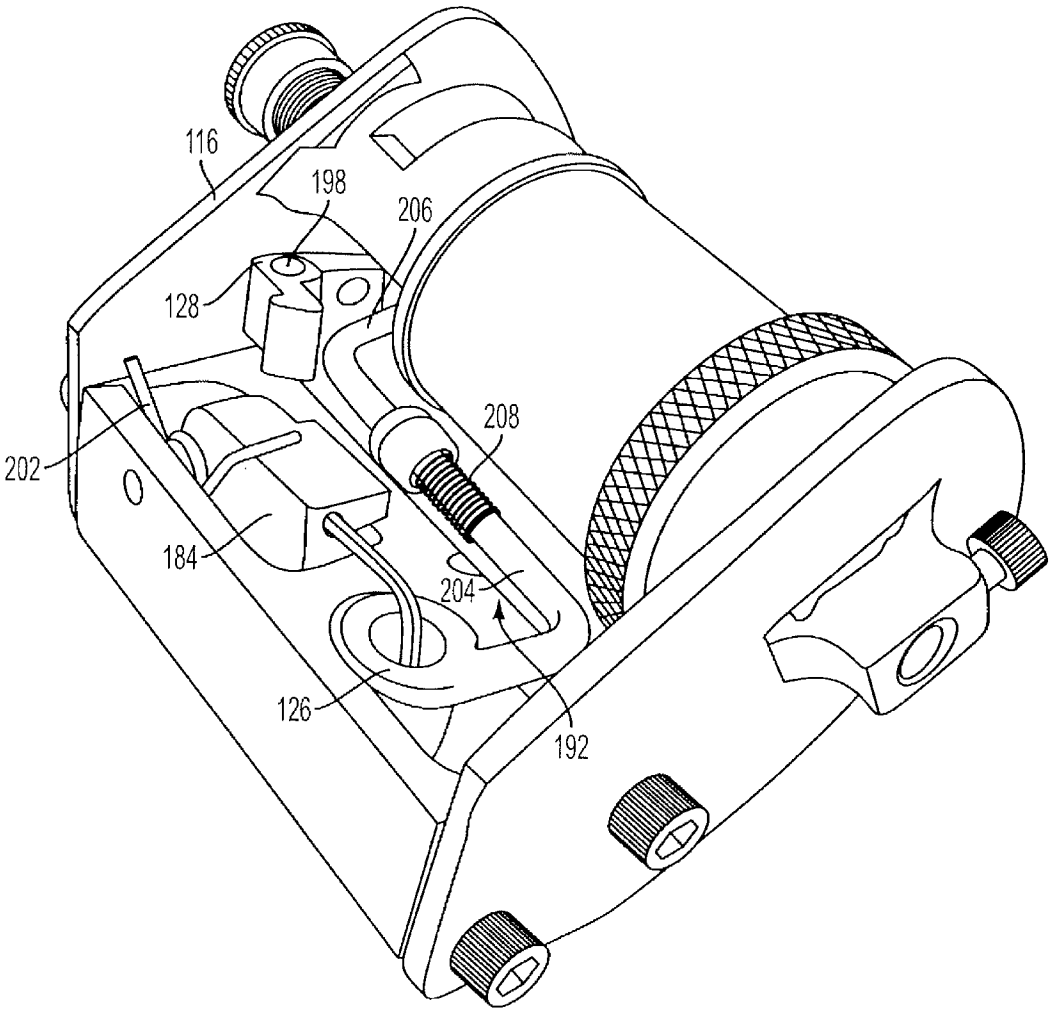
Figure 10:
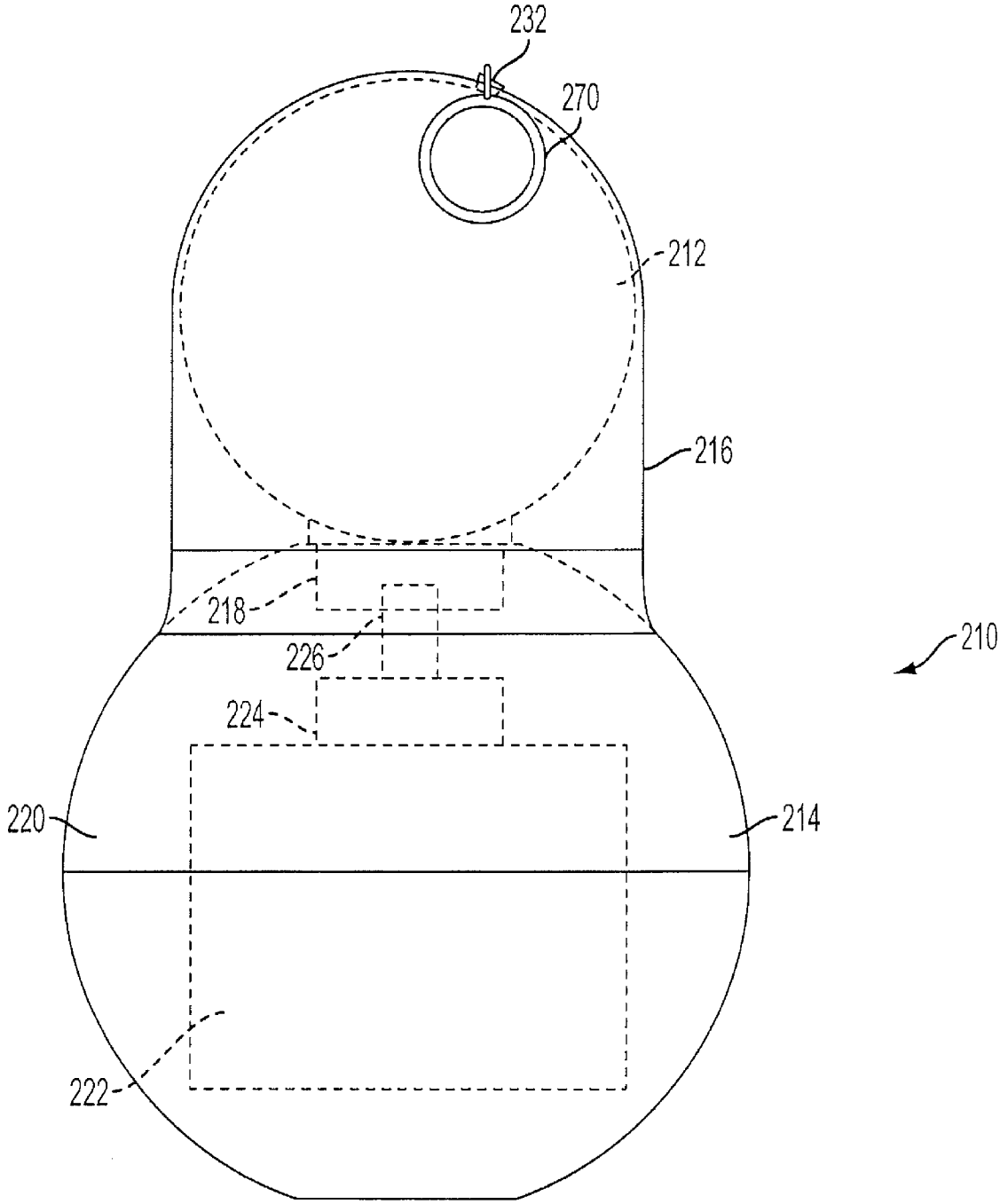
FIG. 10 is a schematic of an alternate embodiment of a detonation mechanism secured to a grenade body.

While a preferred embodiment has been described above, alternate safety mechanisms are contemplated in accordance with preferred embodiments of the present invention. With reference to FIGS. 5, 6, 7, 8 and 9, the alternate safety mechanisms are disclosed. The figures are primarily directed to the safety mechanisms discussed below, and the actuation mechanism is substantially similar to that described above with reference to FIGS. 1, 2A, 2B, 3 and 4. Briefly, the alternate safety mechanisms include a trigger stop mechanism 190 and a spring plate/primer alignment mechanism 192. The trigger stop mechanism 190 includes a bolt 193 secured to the rear side 194 of the trigger 128 such that the trigger 128 may only be pivotally moved for release of the spring plate 184 when a stop plate member 196 along the outer surface of the grenade housing 116 is moved out of the way of the bolt 193 permitting pivotal movement of the trigger 128 about a pivot pin 198 secured mounted within the housing 116, which ultimately results in release of the spring plate 184 for detonation. More particularly, and with reference to FIGS. 5, 6 and 7, the trigger 128 is shown in its predetonation configuration with the selectively blocked opening 200 in the housing 116 opened such that the trigger 128 may be actuated (that is, pivoted) upon movement of the trigger nut 136. As such, when the trigger nut 136 is actuated for movement as described above and comes into contact with the trigger 128, the trigger 128 attempts to pivotally move about the pivot pin 198 (and is permitted to pivotally move) because the opening 200 in the housing 116 is not covered by the stop plate member 196 pivotally secured thereto. The stop plate member 196 is mounted along the housing 116 for movement between a firing position in which the opening 200 is not covered and a safety position (see broken lines in FIG. 6) in which the stop plate member 196 covers the opening 200 to prevent pivotal motion of the trigger 128 since the bolt 193 will contact the stop plate member 196 when the trigger 128 attempts to rotate about the pivot pin 198. As the arrow drawn in FIG. 6 shows, the stop plate member 196 may be moved between its firing position and its safety position through rotation thereof.

Ultimately, and as described above, when the trigger nut 136 comes into contact with the trigger 128 and moves the trigger 128, the trigger 128 is actuated from its position blocking the spring plate 184 which is then moved under control of the detonation spring 202 such that the spring plate 184 contacts the primer 126 igniting the ignition charge (not shown in this embodiment) which ultimately ignites the explosive charge (not shown in this embodiment) held within the explosion chamber (not shown in this embodiment).

As discussed above, safety is further provided through the utilization of a spring plate/primer alignment mechanism 192. In accordance with the alignment mechanism 192, the primer 126 is moved between an alignment position (see FIGS. 8 and 9) allowing for interaction with the spring plate 184 and a safety position where the primer 126 is removed from alignment with the spring plate 184 such that actuation thereof is prevented. Movement of the primer 126 is achieved via a linkage mechanism 204 that it contacted by the trigger nut 136 at the same time the trigger 128 is actuated by the trigger nut 136. As such, when the trigger nut 136 comes into contact with the trigger 128, the linkage mechanism 204 is also actuated by the trigger nut 136 causing movement of the primer 126 relative to the spring plate 184. More particularly, the trigger nut 136 contacts the distal end 206 of the linkage mechanism 204 to provide lateral force along the linkage mechanism 204 pulling the primer 126 laterally and into alignment with the detontation position of the spring plate 184 as shown with reference to FIGS. 8 and 9. The linkage mechanism 204 is further provided with a spring 208 biasing the primer 126 to its safety position (see FIGS. 5, 6 and 7) until such a time that the trigger nut 136 pulls upon the linkage mechanism 204 and moves the primer 126 from its safety position (see FIGS. 5, 6 and 7) to its detonation position (see FIGS. 8 and 9).

Various safety mechanisms are described above. These safety mechanisms may be used individually or in various combinations.

Referring now to FIGS. 10 to 15, an alternate embodiment of the present invention is disclosed. The alternate embodiment provides a variable distance detonation mechanism 212 for a grenade 210. As with the prior embodiment, the variable distance detonation mechanism 212 is screwed onto a traditional grenade body 214 in a manner allowing existing grenade bodies to be modified as needed with the present variable distance detonation mechanism 212. The housing 216 of the present variable distance detonation mechanism 212 is provided with a threaded attachment 218 for screwing the variable distance detonation mechanism 212 to the grenade body 214 in a manner well known to those skilled in the art.

As with the embodiment previously disclosed, the grenade 210 includes an explosion chamber 220 having an explosive charge 222 to which an ignition charge 224 is connected. The ignition charge 224 is detonated by the primer 226 and the trigger 228 of the present variable distance detonation mechanism 212. When the trigger 228 is moved to permit firing of the primer 226 via the bias supplied by the primer detonation mechanism, the ignition charge 224 is ignited detonating the explosive charge 222 held within the explosion chamber 220.

Controlled activation of the trigger 228, primer detonation spring 230 and primer 226 is achieved by the present variable distance detonation mechanism 212. The present variable distance detonation mechanism 212 includes a pull pin safety tether 232 and string 274 (which is connected to the pull pin safety tether) linked to a rotating activation mechanism 234 that ultimately acts upon the trigger 228 to release the primer detonation spring 230 that acts upon the primer 226 to ignite the ignition charge 224 and explosive charge 222. The rotating activation mechanism 234 includes a trigger nut 236 mounted upon an adjustment bolt 238. The trigger nut 236 is selectively rotated relative to the adjustment bolt 238 in a manner creating longitudinal movement of the trigger nut 236 along the adjustment bolt 238 for actuation of the trigger 228 in a manner discussed below in greater detail. A spool 240 is rotatably connected to the trigger nut 236 and the adjustment bolt 238 via a gearing arrangement 280 that creates rotation of the adjustment bolt 238 (relative to the trigger nut 236) as the pull pin safety tether 232 is pulled and string 274 is pulled from the spool 240.

The trigger nut 236 is mounted along the adjustment bolt 238 in a keyed relationship. The keyed relationship allows for the adjustment bolt 238 to rotate relative to the trigger nut 236 in a manner allowing for longitudinal movement but preventing rotational movement of the trigger nut 236 relative to the remainder of the housing 216 of the variable distance detonation mechanism 212. The trigger nut 236 includes internal threading 250 shaped and dimensioned to mate with external threading 252 on the adjustment bolt 238. As a result, when the pull pin safety tether 232 is pulled and string 274 is pulled from the spool 240 causing it to rotate, the gear 284 of the spool 240 acts upon the gear 286 of the adjustment bolt 238 via a linking gear 288 causing rotation of the adjustment bolt 238 relative to the trigger nut 236. Because the trigger nut 236 is prevented from rotating relative to the housing 216, because of its interaction with the a guide post 248 positioned parallel to the adjustment bolt 238, the trigger nut 236 does not rotate with the adjustment bolt 238 but rather moves longitudinally along the adjustment bolt 238 as it rides along the threads 252 of the adjustment bolt 238. As the adjustment bolt 238 is rotated, the adjustment bolt 238 rotates relative to the trigger nut 236 causing the trigger nut 236 to move along the adjustment bolt 238 until such a time as the trigger nut 236 hits the trigger arm 229 of the trigger 228 in a manner discussed below in greater detail.

More particularly, the activation mechanism 234 relies upon movement of the trigger nut 236 as it is guided along the adjustment bolt 238 and into engagement with a trigger arm 229 (that is coupled to the trigger 228 via a threaded guide member 304) and ultimately acts upon the trigger 228 to release the primer detonation spring 230. The trigger arm 229 allows for controlled actuation of the trigger 228 by offering multiple contact surfaces 231*a*, 231*b*, 231*c* for selective engagement with the trigger nut 236 as it is moved along the adjustment bolt 238. As such, and depending upon the position of the trigger arm 229 relative to the trigger nut 236, the trigger nut 236 must be moved a lesser or greater distance before contact between the trigger nut 236 and the trigger arm 229 is achieved (and the string 274 must consequently be pulled a lesser or greater distance on the spool 240), and the trigger 228 is actuated for detonation of the grenade 210.

As briefly discussed above, the trigger arm 229 is provided with multiple contact surfaces 231*a*, 231*b*, 231*c* positioned at different positions relative to the trigger nut 236. In accordance with a preferred embodiment, the trigger arm 229 is provided with first, second and third contact surfaces 231*a*, 231*b*, 231*c* oriented to contact the trigger nut 236 at different longitudinal positions along the adjustment bolt 238. The first, second and third contact surfaces 231*a*, 231*b*, 231*c* are staggered in a stepwise orientation such that as the trigger arm 229 is moved away from the adjustment bolt 238 the distance the trigger nut 236 must move along the adjustment bolt 238 before contacting the trigger arm 229 changes.

As briefly discussed above, the activation mechanism 234 includes a spool 240 for rotational movement about a first axis. The spool 240 is connected to the housing 216 for rotation relative thereto. A first end 241 of the spool 240 includes a gear 284 that is ultimately linked to a gear 286 secured to the adjustment bolt 238.

Actuation of the trigger 228 is controlled by a trigger stop mechanism 290. The trigger stop mechanism 290 includes a bolt 293 secured to the rear side 294 of the trigger 228 such that the trigger 228 may only be moved for release of the spring plate 284 when a stop plate member 296 along the outer surface of the housing 216 is moved out of the way of the bolt 293 permitting movement of the trigger 228 as the trigger nut 236 comes into contact with the trigger arm 229, which ultimately results in release of the spring plate 284 for detonation.

Figure 11:
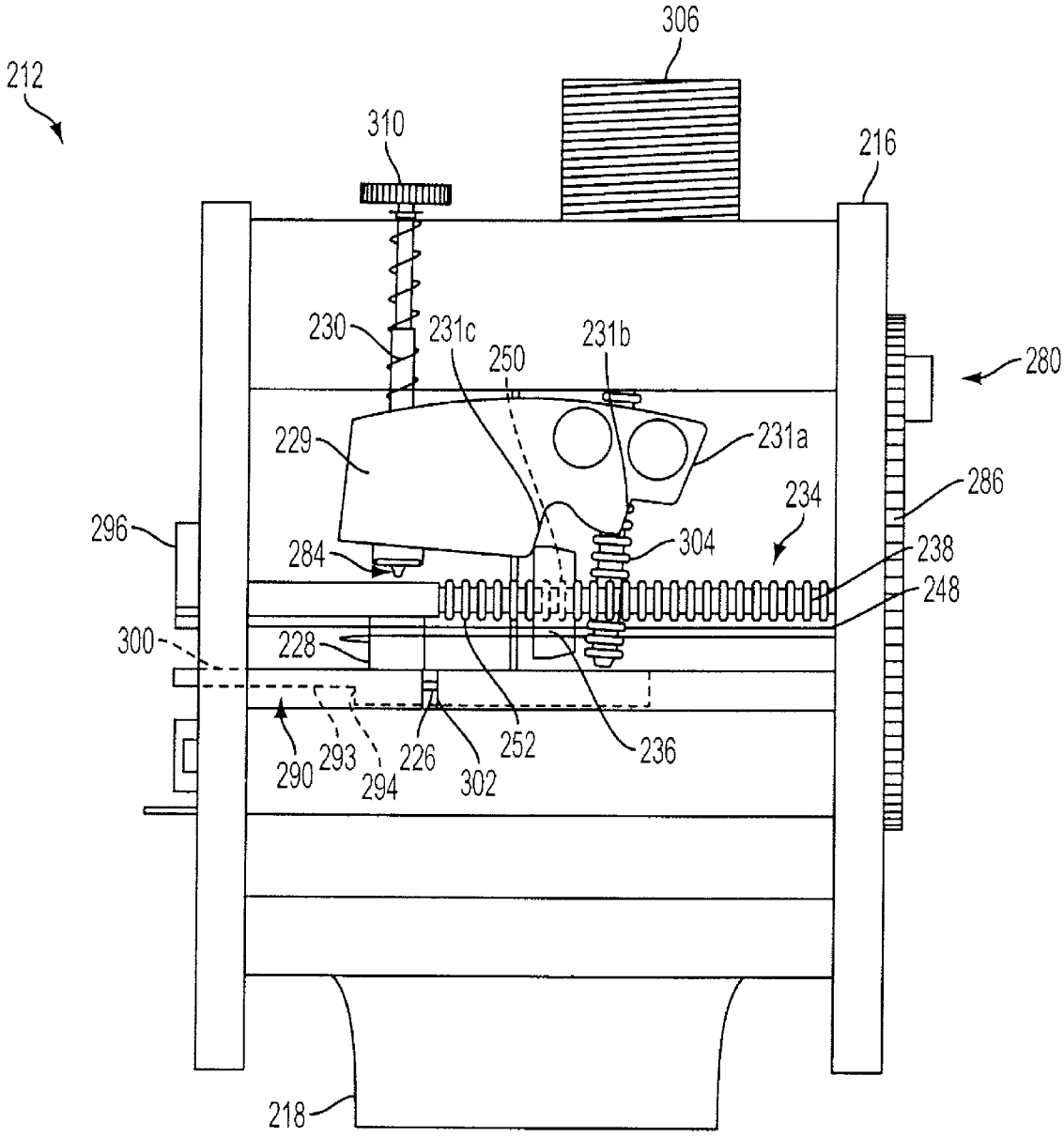
FIG. 11 is a front plan view of the detonation mechanism shown with reference to FIG. 10.
Figure 12:
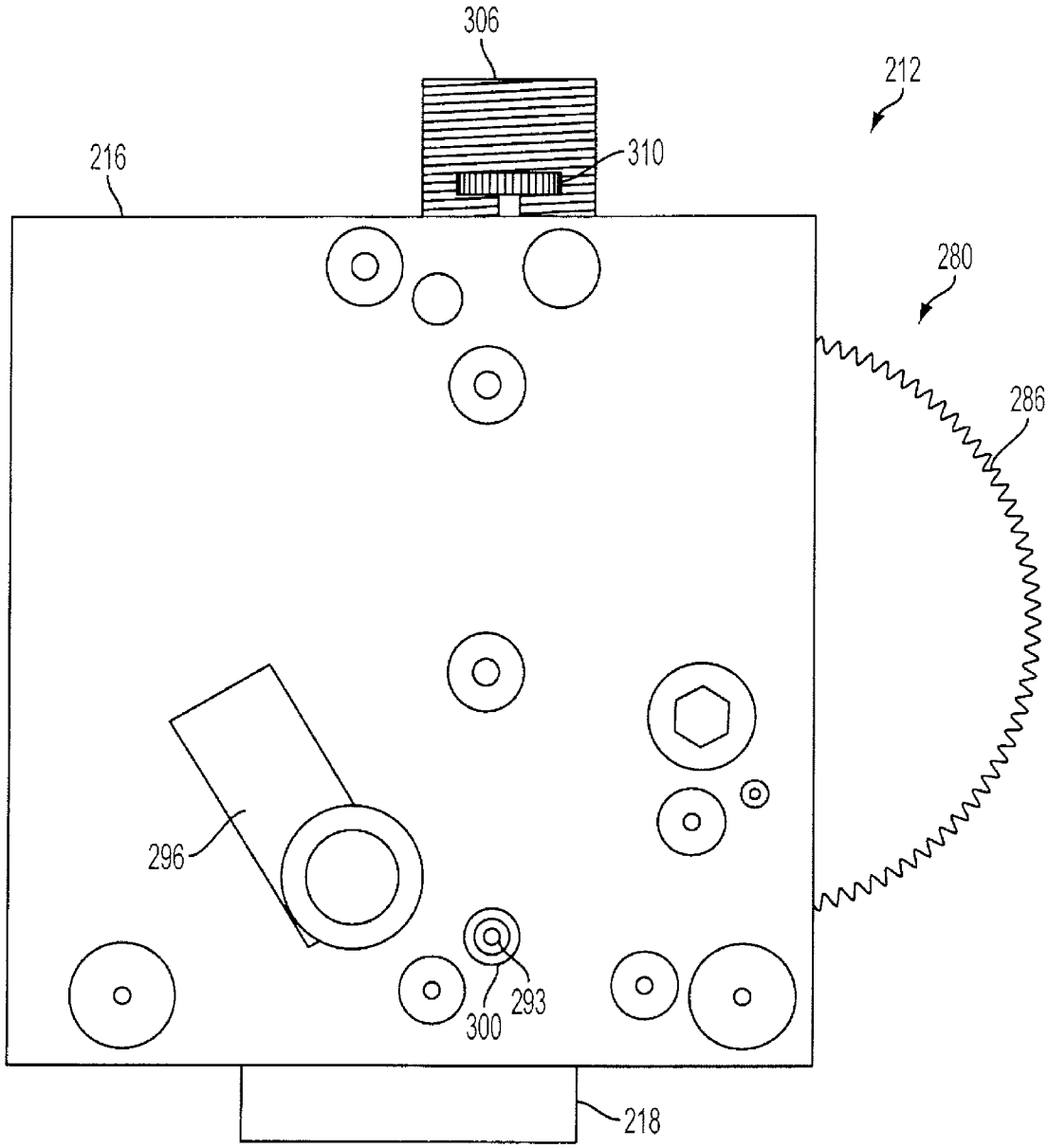
FIG. 12 is a right side plan view of the detonation mechanism shown with reference to FIG. 10.
Figure 13:
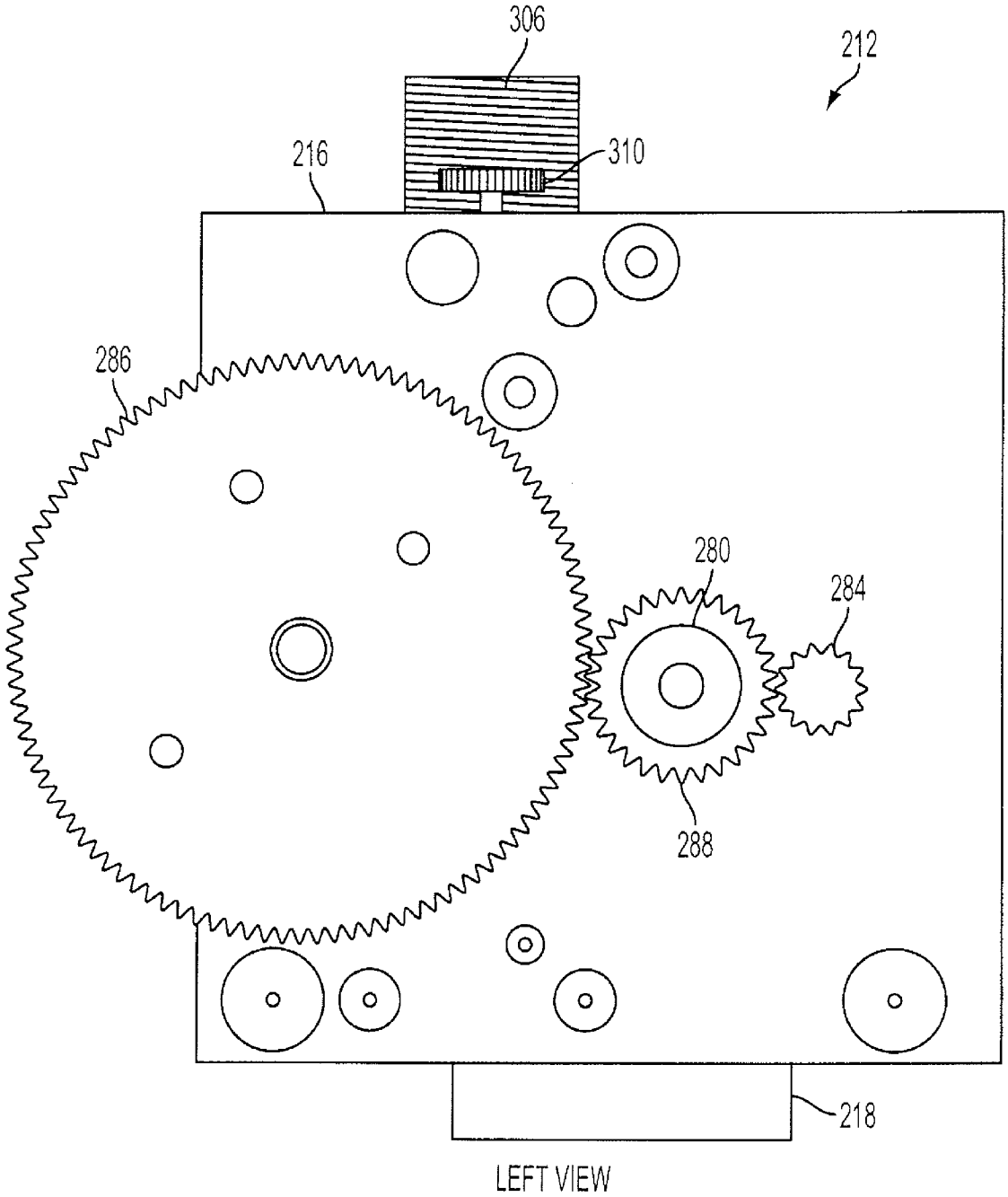
FIG. 13 is a left side plan view of the detonation mechanism shown with reference to FIG. 10.
Figure 14:
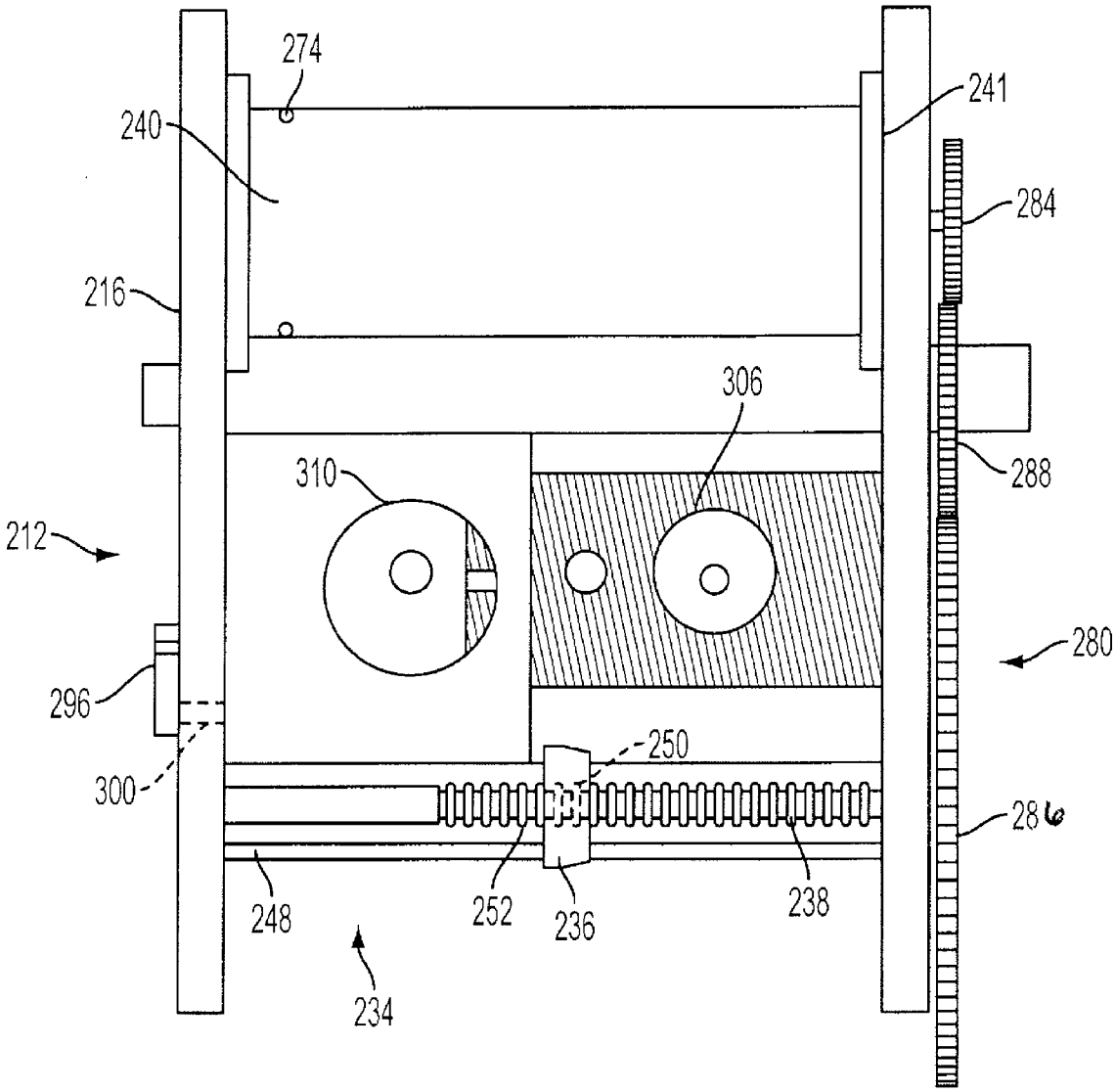
FIG. 14 is a top plan view of the detonation mechanism shown with reference to FIG. 10.
Figure 15:
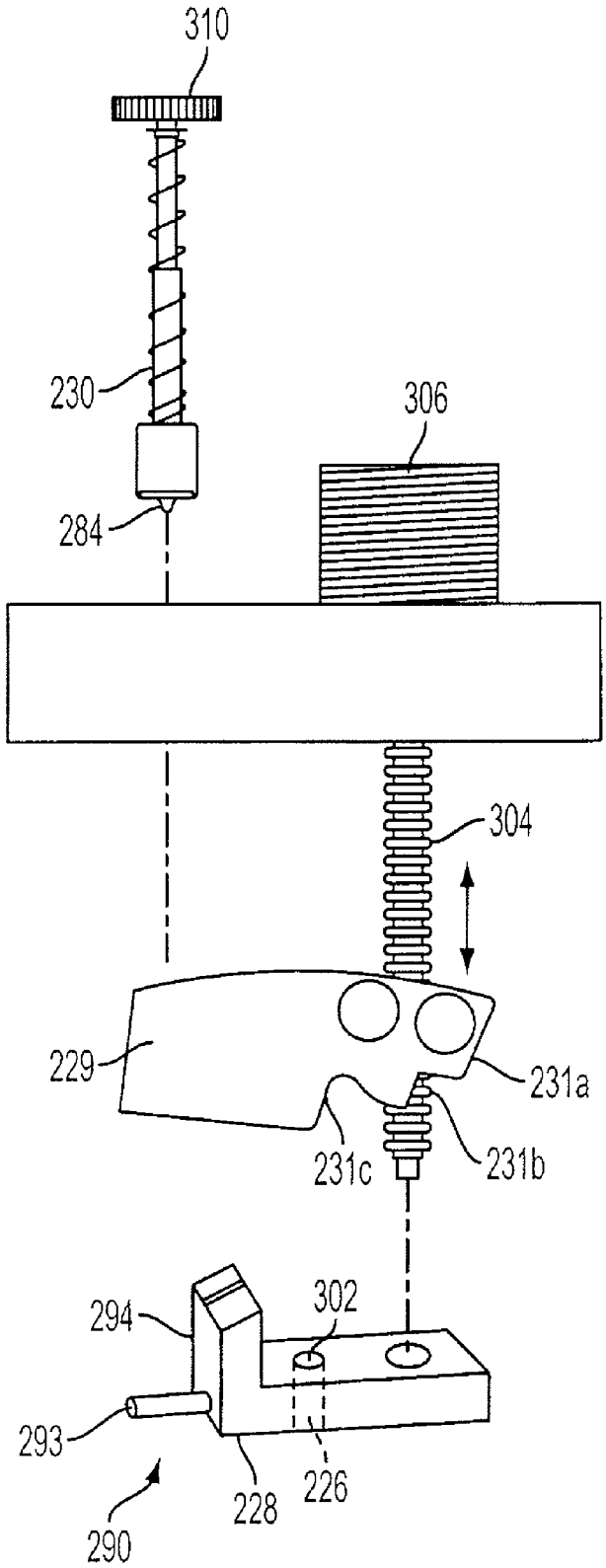
FIG. 15 is an exploded view of the trigger mechanism of the detonation mechanism shown with reference to FIG. 10.

Referring to FIGS. 11 and 12, the trigger 228 is shown in its pre-detonation configuration with the selectively blocked opening 300 in the housing 216 open such that the trigger 228 may be actuated (that is, moved laterally (and in the disclosed embodiment to the left)) upon movement of the trigger nut 236 into engagement with the trigger arm 229. As such, when the trigger nut 236 is actuated for movement as described above and comes into contact with the trigger arm 229 (and ultimately the trigger), the trigger 228 attempts to laterally move because the opening 300 in the housing 282 is not covered by the stop plate member 296 pivotally secured thereto. The stop plate member 296 is mounted along the housing 282 for movement between a firing position in which the opening 300 is not covered (see FIGS. 11 and 12) and a safety position in which the stop plate member 296 covers the opening 300 to prevent motion of the trigger 228 since the bolt 293 will contact the stop plate member 296 when the trigger 228 attempts to rotate about the pivot pin 298 (see FIG. 14).

Ultimately, when the trigger nut 236 comes into contact with the trigger 228 and moves the trigger 228, the trigger 228 is actuated (that is, moved to the left as disclosed in the embodiment presented herein) from its position blocking the spring plate 284 which is then moved under the control of the detonation spring 230 such that the spring plate 284 is biased through an opening 302 in the trigger 228 contacting the primer 226 and igniting the ignition charge 224 which ultimately ignites the explosive charge 222 held within the explosion chamber 220.

In practice, a ring 270 at the first end of the pull pin safety tether 232 (which is connected to the string 274 wrapped around the spool 240) is gripped and pulled away from the housing 216. This causes the pull pin safety tether 232 to be pulled from the housing 216 in a manner initiating the detonation process. As the pull pin safety tether 232 is drawn about the housing 216 and away from the spool 240, unwinding of the spool 240 is started because the string 274 wrapped around the spool 240 is fixedly coupled to the pull pin safety tether 232.

Once the pull pin safety tether 232 is fully removed from the housing 216, the user may throw the grenade 210 with one hand while holding the ring 270 with the other hand. That is, the grenade 210 is armed and can be either thrown while retaining the pull pin safety tether 232 or placed at a desired location. In either case, as the pull pin safety tether 232 is pulled further from the spool 240, the string 274 connected between the spool 240 and the pull pin safety tether 232 is withdrawn from the spool 240 causing the spool 240 to rotate. Rotation of the spool 240 in turn causes the adjustment bolt 238 to rotate via the gearing 280 connecting the spool 240 to the adjustment bolt 238. As the adjustment bolt 238 rotates, the threading 250, 252 between the trigger nut 236 and the adjustment bolt 238 causes the trigger nut 236 to move along the adjustment bolt 238 and be brought closer and closer to the trigger arm 229. As the grenade 210 is thrown a distance from the user, the string 274, which is held at is first end 272 by the user gripping the ring 270, will unwind from the spool 240 causing the spool 240 to rotate. Rotation of the spool 240 will similarly cause rotation of the adjustment bolt 238 to which the trigger nut 236 is coupled for rotation relative thereto.

More particularly, as the adjustment bolt 238 is rotated relative to the trigger nut 236 under the force created by rotation of the spool 240, it will move along the adjustment bolt 238 with the threading of the trigger nut 236 interacting with the threading 250 of the adjustment bolt 238. The trigger nut 236 will eventually come into contact with either the first, second or third contact surfaces 231*a*, 231*b*, 231*c* of the trigger arm 229 of the trigger 228.

The distance the trigger nut 236 must travel before coming into contact with the trigger arm 229 is directly related to the distance the grenade 210 must travel and the amount of string 274 that must be unwound from the spool 240. As those skilled in the art will certainly appreciate, this is based upon the diameter of the spool 240, the gearing connecting the spool 240 to the adjustment bolt 238, the threading 250, 252 of the trigger nut 236/adjustment bolt 238, and the relative position of the trigger arm 229 so as to selectively control which of the first second or third contact surfaces 231*a*, 231*b*, 231*c* is aligned with the trigger nut 236. As a result, one can readily adjust the distance the grenade 210 must travel before detonation by adjusting the position of the trigger arm 229 so as to control at which point along the adjustment bolt 238 the trigger nut 236 comes into contact with the trigger arm 229. Adjustment of the trigger arm 229 is achieved by the inclusion of a threaded guide member 304 upon which the trigger arms 229 rides so as to selectively permit adjustment of the trigger arm thereon my simple rotation of the threaded guide member. Because the trigger arm 229 is threadingly engaged to the threaded guide member 304 and prevented from rotating relative to the housing 216 because of its position within the housing 216, rotation of the knob 306 on the end of the threaded guide member 304 will cause the trigger arm 229 to move up and down changing the position at which the trigger nut 236 will contact the trigger arm 229 through engagement with the first, second and third contact surfaces 231*a*, 231*b*, 231*c* of the trigger arm 229.

When the trigger nut 236 comes into contact with the trigger 228 and moves it, the trigger 228 is moved from its position blocking the primer detonation spring 230. The primer detonation spring 230 and spring plate 284 are then released, causing the spring plate 284 attached to the primer detonation spring 230 to contact the primer 226 igniting the ignition charge 224 which ultimately ignites the explosive charge 222 held within the explosion chamber 220. If desired, the system may then be reset by pulling upwardly on the handle 310 of the spring plate 284 and moving the trigger 228 to its start position as shown in FIG. 11.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A grenade, comprising:

an explosion chamber including an explosive charge to which an ignition charge is connected;

a primer and trigger coupled to the ignition charge for detonation of the explosive charge held within the explosion chamber;

a variable distance detonation mechanism coupled to the trigger and the primer for allowing controlled detonation of the grenade a specific distance from a launch point thereof; the variable distance detonation mechanism includes a rotating activation mechanism that acts upon the trigger for detonation of the grenade wherein the rotating activation mechanism includes a trigger nut mounted upon an adjustment bolt such that the trigger nut selectively rotates relative to the adjustment bolt in a manner creating longitudinal movement of the trigger nut along the adjustment bolt for actuation of the trigger.

2. The grenade according to claim 1, wherein a spool is rotatably connected to the trigger nut and the adjustment bolt via a gearing arrangement that creates rotation of the adjustment bolt as a string is pulled from the spool.

3. The grenade according to claim 1, wherein a trigger arm is coupled to the trigger and the trigger nut acts upon the trigger arm for actuation of the trigger.

4. The grenade according to claim 3, wherein the trigger arm includes multiple contact surfaces for selective engagement with the trigger nut as it is moved along the adjustment bolt.

5. A grenade, comprising:

an explosion chamber including an explosive charge to which an ignition charge is connected;

a primer and trigger coupled to the ignition charge for detonation of the explosive charge held within the explosion chamber;

a variable distance detonation mechanism coupled to the trigger and the primer for allowing controlled detonation of the grenade a specific distance from a launch point thereof; the variable distance detonation mechanism includes a rotating activation mechanism that acts upon the trigger for detonation of the grenade;

including a trigger stop mechanism preventing movement of the trigger;

wherein the trigger stop mechanism includes a bolt secured to the trigger such that the trigger may only be moved when a stop plate member is moved out the way of the bolt permitting movement of the trigger.

* * * * *